US005676287A

United States Patent [19]

Huang

[11] Patent Number: 5,676,287

[45] Date of Patent: Oct. 14, 1997

[54] FOLDING COLLAPSIBLE FRAME ASSEMBLY OF A BABY CARRIER

[76] Inventor: Mien Chen Huang, No. 123-2, Peitou Village, Kuanmiao, Tainan, Taiwan

[21] Appl. No.: 649,381

[22] Filed: May 16, 1996

[51] Int. Cl.[6] ..... A45F 3/00; A47D 13/02; A61G 1/00

[52] U.S. Cl. ..... 224/161; 224/155

[58] Field of Search ..... 224/161, 160, 224/159, 155, 634; 297/118, 130, 55, 377

[56] References Cited

U.S. PATENT DOCUMENTS

| | | | |
|---|---|---|---|
| 4,044,931 | 8/1977 | Catelli | 224/161 |
| 4,676,466 | 6/1987 | Nakao et al. | 224/160 |
| 4,718,715 | 1/1988 | Ho | 224/155 |

*Primary Examiner*—Linda J. Sholl

*Attorney, Agent, or Firm*—Pro-Techtor International

[57] ABSTRACT

The folding collapsible frame assembly of a baby carrier which includes a U-shaped front tube, a U-shaped rear tube having two opposite ends respectively pivoted to two connecting frames at two opposite ends of the front tube, two side tubes pivoted to the two connecting frames, each side tube having a spring plate with a raised portion adapted for engaging a respective retaining hole on one connecting frame to hold the side tubes in the operative position, a U-shaped top tube, two holder frames fixedly connected to the two opposite ends of the U-shaped top tube and pivoted to the side tubes at one end remote from the connecting frames, two spring-supported sockets movably mounted around the side tubes and having a respective top flange adapted for engaging respective bottom notches on the holder frame to hold the top tube between the operative position and the collapsed position.

4 Claims, 6 Drawing Sheets

FOLDING COLLAPSIBLE FRAME ASSEMBLY OF A BABY CARRIER

BACKGROUND OF THE INVENTION

The present invention relates to baby carriers, and relates more specifically to the frame assembly of a baby carrier which is folding collapsible.

Various baby carriers have been disclosed for carrying a baby on the shoulder. In order to save storage space, regular baby carriers are commonly made collapsible. FIGS. from 1 to 6 show the structure of a folding collapsible frame assembly for a baby carrier. As illustrated in FIGS. 1, 2, and 3, this structure of folding collapsible frame assembly comprises a pair of side tubes (10), a cross tube (103), a substantially U-shaped rear tubes (20), and a substantially U-shaped top tube (30). The cross tube (103) is connected between the side tubes (10). The rear tube (20) has two opposite ends pivotably connected to two first holder frames (40), which are respectively and fixedly secured to the side tubes (10) in the middle. The top tube (30) has two opposite ends fixedly connected to two second holder frames (50), which are pivotably connected to the top ends of the side tubes (10). Referring to FIGS. 4 and 5, the top end of each side tube (10) is fixedly mounted with a respective end cap (101). The end cap (101) is connected to a pivot member (102) at the corresponding second holder frame (50) by a spring (60). Furthermore, the cross tube (103), the top tube (30), and the rear tube (20) have a respective joint (70) in the middle for folding (see FIG. 1). FIG. 6 shows the folding collapsible frame assembly folded up. Because the side tubes (10) are not foldable and the length of the side tubes (10) is longer than the width of the top tube (30), the size of the folding collapsible frame assembly still cannot be reduced to the satisfactory dimension when collapsed. Therefore, this structure of folding collapsible frame assembly still needs much storage space, thereby causing its transportation cost to be high.

SUMMARY OF THE INVENTION

The present invention provides a folding collapsible frame assembly for baby carrier which needs little storage space when collapsed. According to the present invention, the folding collapsible frame assembly comprises a U-shaped front tube, a U-shaped rear tube having two opposite ends respectively pivoted to two connecting frames at two opposite ends of the front tube, two side tubes pivoted to the two connecting frames, each side tube having a spring plate with a raised portion adapted for engaging a respective retaining hole on one connecting frame to hold the side tubes in the operative position, a U-shaped top tube, two holder frames fixedly connected to the two opposite ends of the U-shaped top tube and pivoted to the side tubes at one end remote from the connecting frames, two spring-supported sockets movably mounted around the side tubes and having a respective top flange adapted for engaging respective bottom notches on the holder frame to hold the top tube between the operative position and the collapsed position. Because all of the top tube, the side tubes, the front tube, and the rear tube can be folded up, the size of the folding collapsible frame assembly is minimized when collapsed.

DETAILED DESCRIPTION OF THE PREFERRED EMBODIMENT

Figure 1:
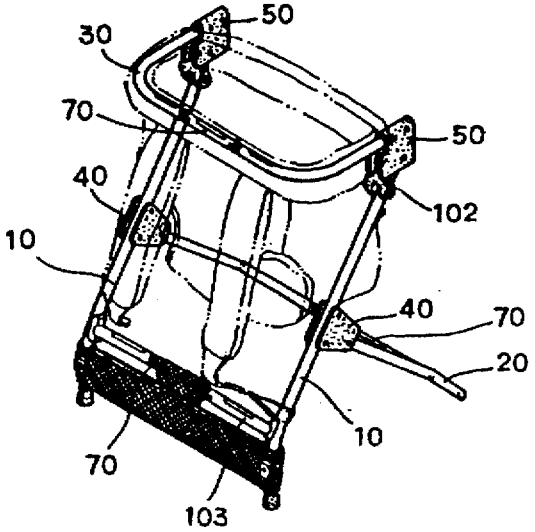
FIG.1 (Prior Art)
FIG. 1 is an extended out view of the folding collapsible frame assembly of a baby carrier according to the prior art.
Figure 2:
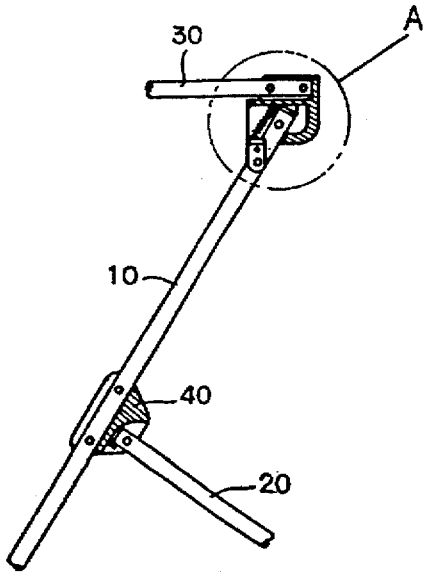
FIG.2 (Prior Art)
FIG. 2 is a side plain view of the folding collapsible frame assembly shown in FIG. 1 when extended out.
Figure 3:
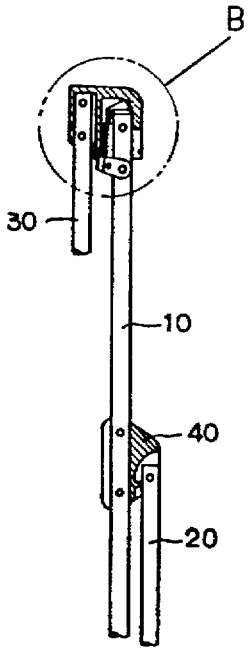
FIG.3 (Prior Art)
FIG. 3 is a side plain view showing the folding collapsible frame assembly shown in FIG. 1 when collapsed.
Figure 4:
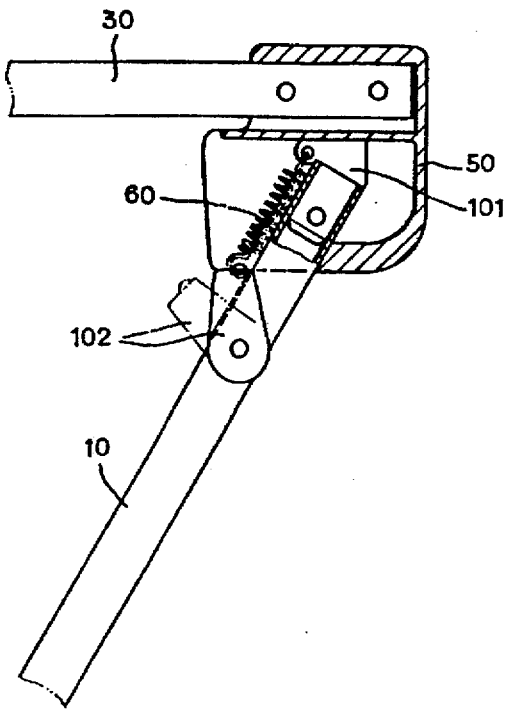
FIG.4 (Prior Art)
FIG. 4 is an enlarged view of part A of FIG. 2.
Figure 5:
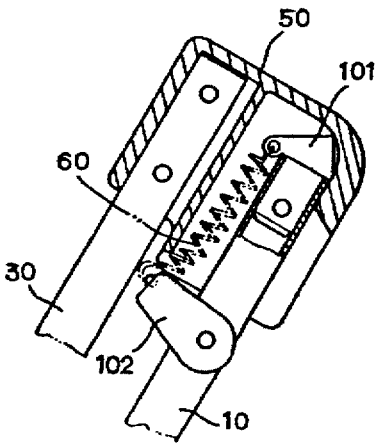
FIG.5 (Prior Art)
FIG. 5 is an enlarged view of part B of FIG. 3.
Figure 6:
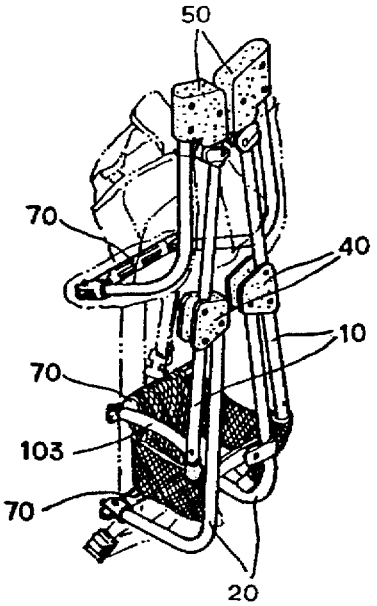
FIG.6 (Prior Art)
FIG. 6 is an elevational view of the folding collapsible frame assembly shown in FIG. 1 when folded up.
Figure 7:
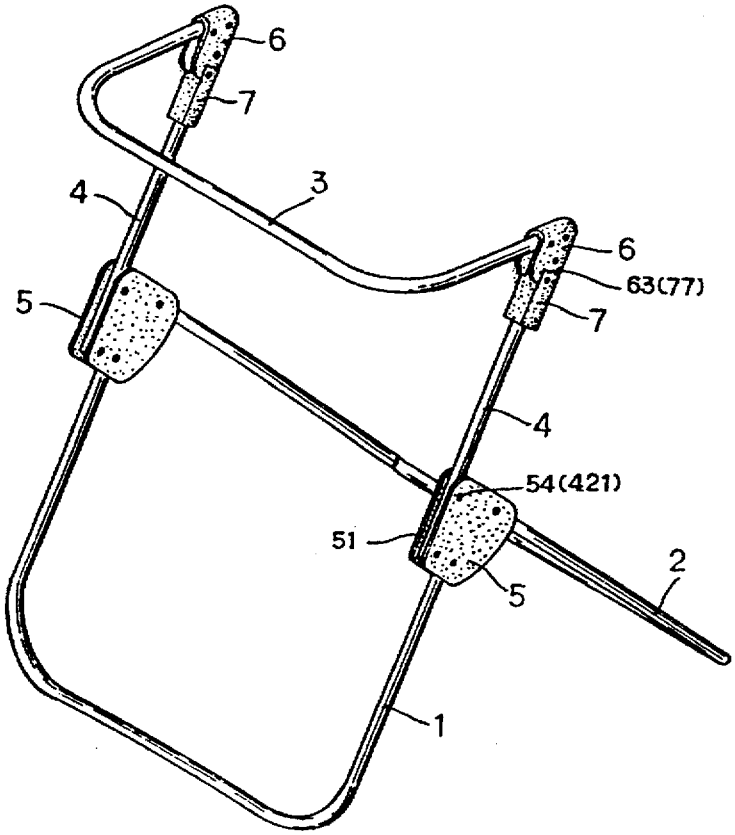
FIG. 7 is an elevational view of the present invention, showing the collapsible frame assembly extended out and set in the operative position.

Referring to FIG. 7, the folding collapsible frame assembly of a baby carrier in accordance with the present invention is generally comprised of a substantially U-shaped front tube 1, a substantially U-shaped rear tube 2, a substantially U-shaped top tube 3, a pair of side tubes 4, a pair of connecting frames 5, a pair of holder frames 6, and a pair of sockets 7. The two opposite ends of the front tube 1, the two opposite ends of the rear tube 2, and the bottom ends of the side tubes 4 are respectively connected to the connecting frames 5. The top ends of the side tubes 4 and the two opposite ends of the top tube 3 are connected together by the holder frames 6 and the sockets 7.

Referring to FIGS. from 8 to 11, each of the connecting frames 5 comprises a top open chamber 51 which receives the bottom end of one side tube 4, a bottom open chamber 53 which receives one end of the rear tube 2, a bottom axle hole 52 disposed between the top open chamber 51 and the bottom open chamber 53 which receives one end of the front tube 1, and a stop block 531 disposed at one side of the bottom open chamber 53. The two opposite ends of the rear tube 2 are respectively pivoted to the bottom open chambers 53 of the connecting frames 5. When the rear tube 2 is turned outwards from the front tube 1, it will be stopped at the stop block 531 and maintained at a fixed angle for example 90° relative to the front tube 1. When to collapse the frame assembly, the rear tube 2 is turned inwards toward the front tube 1 (see FIG. 9). The bottom ends of the side tubes 4 are respectively pivoted to the top open chambers 51 of the connecting frames 5. Each of the side tubes 4 comprises a slot 41 spaced from the bottom end, a spring plate 42 fixedly mounted inside the slot 41 and having a raised portion 421 at an outer side partially projecting out of the slot 41. Each of the connecting frames 5 has a retaining hole 54 disposed in communication with the respective top open chamber 51.

Figure 8:
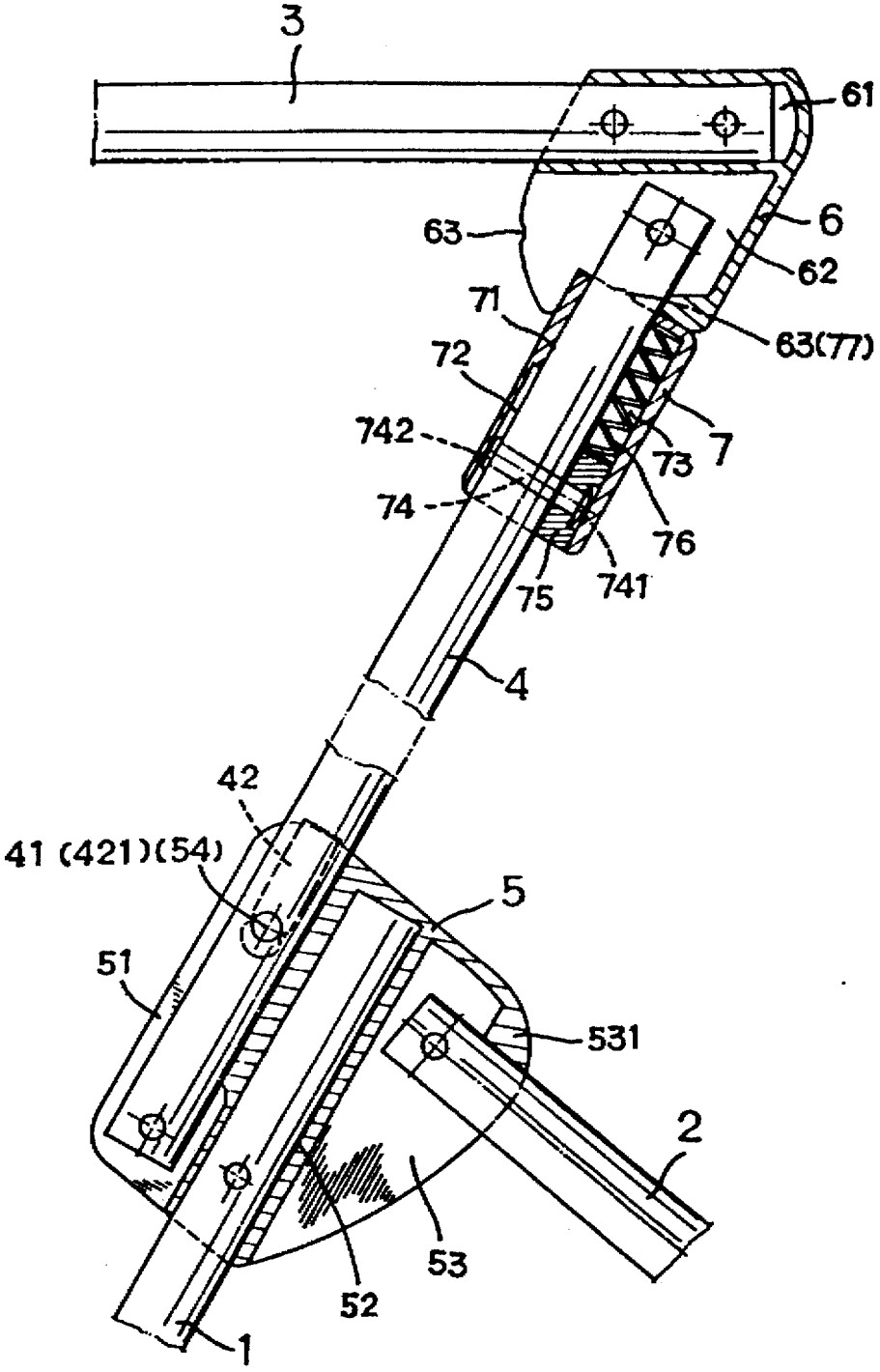
FIG. 8 is a sectional side view in an enlarged scale of FIG. 7.
Figure 9:
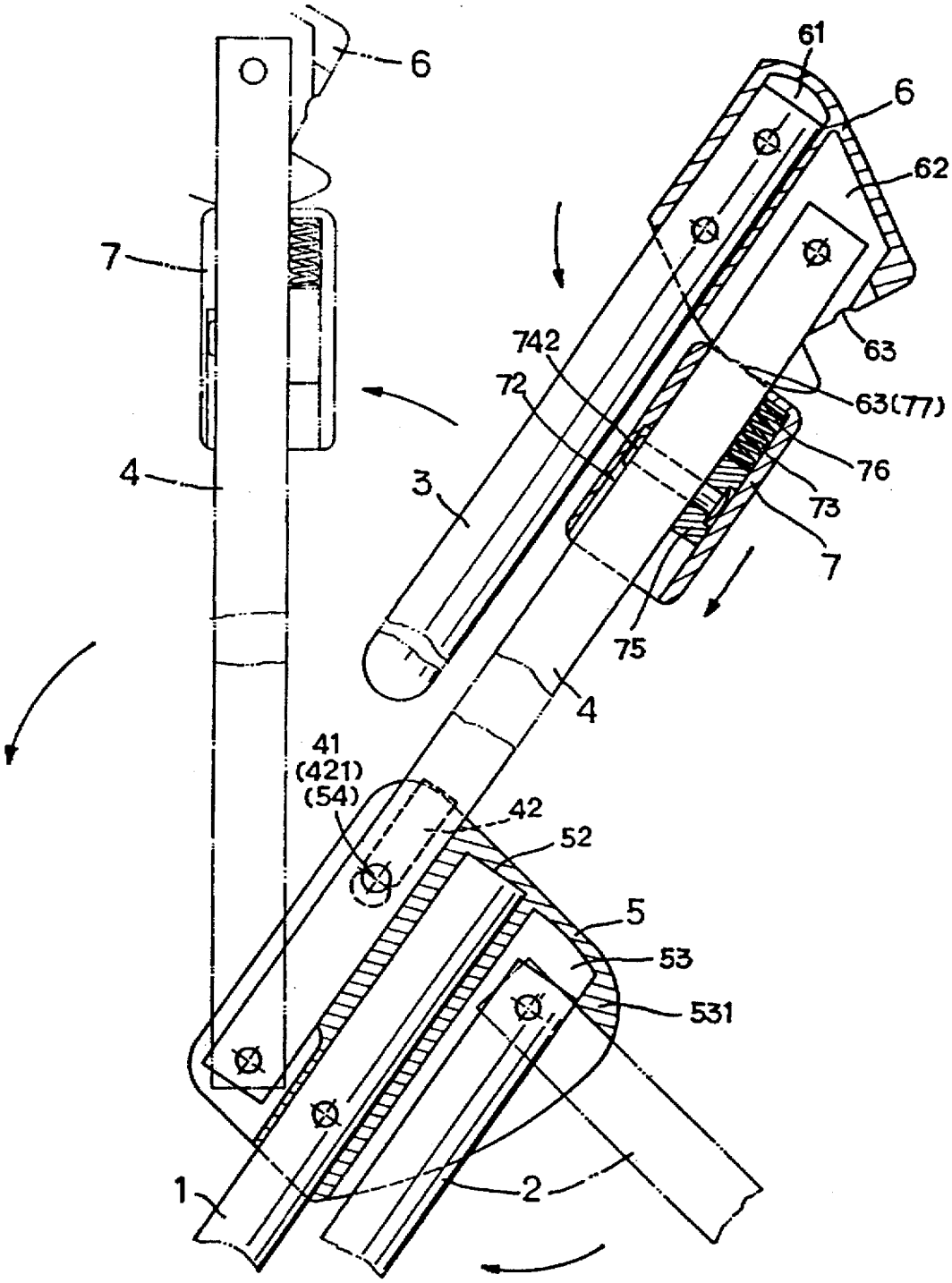
FIG. 9 is a schematic drawing of the present invention showing the folding directions of the parts thereof.
Figure 10:
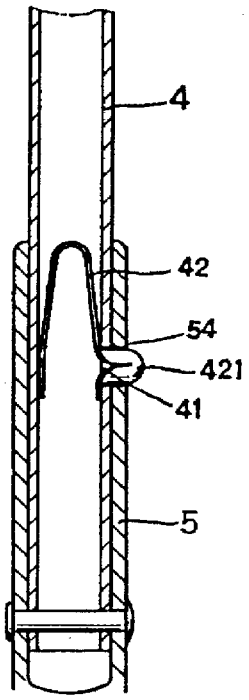
FIG. 10 is a sectional view of a part of the present invention, showing the raised portion of the spring plate of the side tube forced into engagement with the retaining hole of the corresponding connecting frame.
Figure 11:
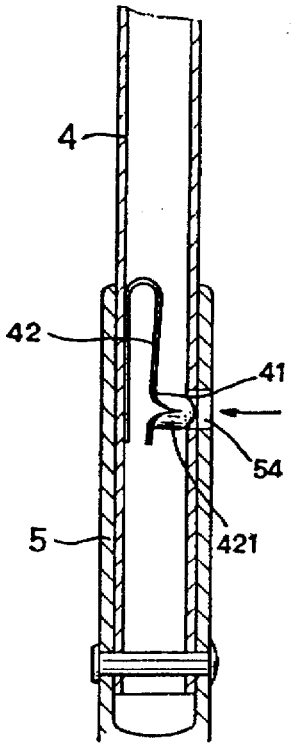
FIG. 11 is similar to FIG. 10 but showing the raised portion of the spring plate of the side tube disengaged from the retaining hole of the corresponding connecting frame.

When the side tubes 4 are turned into the top open chambers 51 of the connecting frames 5, the raised portions 421 of the spring plates 42 of the side tubes 4 are respectively forced into engagement with the retaining holes 54 of the connecting frames 5, and therefore the side tubes 4 are retained in the operative position (see FIGS. 8 and 10). When the raised portions 421 of the spring plates 42 of the side tubes 4 are pushed inwards (see FIG. 11), the side tubes 4 can then be turned out of the top open chambers 51 of the connecting frames 5 and collapsed (see FIG. 9).

Referring to FIGS. 7, 8, and 9, each of the holder frames 6 comprises a horizontal open chamber 61 at the top which receives one end of the top tube 3, a vertical open chamber 62 at the bottom which receives the top end of one side tube 4, and two bottom notches 63. The two opposite ends of the top tube 3 are respectively and fixedly fastened to the horizontal open chambers 61 of the holder frames 6. The sockets 7 are respectively mounted around the side tubes 4. Each of the sockets 7 comprises a longitudinal through hole 71 through which the top end of the respective side tube 4 passes, a longitudinal sliding groove 72 and a spring chamber 73 respectively extended to the bottom and disposed in communication with the longitudinal through hole 71 at two opposite sides, and a top flange 77 forced into engagement with one of the two bottom notches 63 of the corresponding holder frame 6. A rivet 74 is transversely fastened to each side tube 4, having a head 75 and a tail 742 respectively extended out of the periphery of the respective side tube 4. The tail 742 of the rivet 72 perpendicularly projects into the longitudinal sliding groove 72 of the socket 7 on the respective side tube 4. The head 741 of the rivet 72 is fixedly mounted with a block 75, which is disposed in the spring chamber 73 of the socket 7 on the respective side tube 4. A spring 76 is mounted in the spring chamber 73 of each socket 7, having a top end connected to the inside wall of the respective socket 7 and a bottom end connected to the corresponding block 75. The spring 76 imparts an upward pressure to the respective socket 7, causing the top flange 77 of the respective socket 7 to be forced into engagement with one bottom notch 63 of the holder frame 6. When the sockets 7 are moved downward along the side tubes 4, the respective springs 76 are compressed, and the respective top flanges 77 are disengaged from the bottom notches 63 of the respective holder frames 6, and therefore the respective holder frames 6 and the top tube 3 can then turned between the operative position (see FIG. 8) and the collapsed position (see FIG. 9). When the holder frames 6 are turned to the operative (collapsed) position and the sockets 7 are released from the hands, the top flanges 77 of the sockets 7 are forced by the respective springs 76 into engagement with the corresponding bottom notches 63 of the holder frames 6 to hold the holder frames 6 and the top tube 3 in the operative (collapsed) position.

Figure 12:
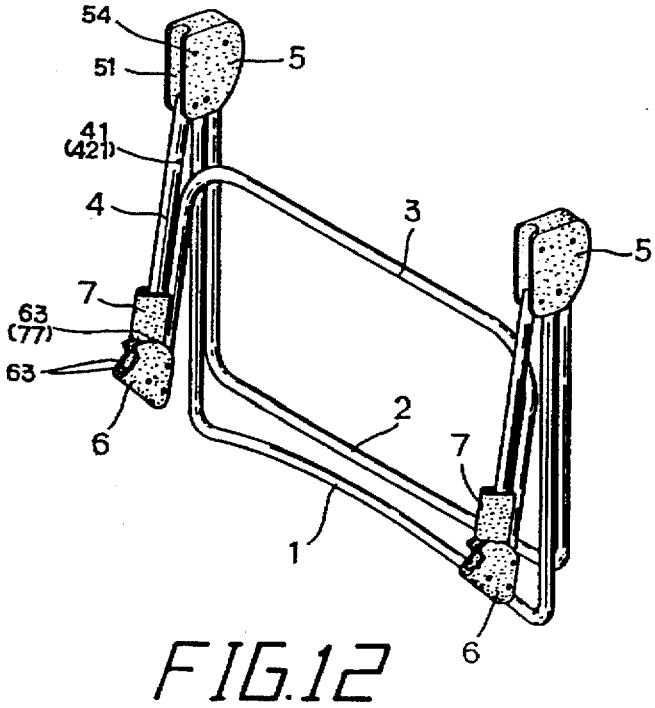
FIG. 12 is another elevational view of the present invention, showing the folding collapsible frame assembly collapsed.

As indicated, the frame assembly of the present invention can be folded up from the operative position shown in FIG. 7 to the collapsed position shown in FIG. 12 by: pulling the sockets 7 downwards along the side tubes 4 to disengage the top flanges 77 of the sockets 7 from the bottom notches 63 of the holder frames 6 and then turning the top tube 3 downwards toward the side tubes 4, then pressing the raised portions 421 of the spring plates 42 of the side tubes 4 inwards and then turning the side tubes 4 out of the top open chambers 51 of the connecting frames 5 to closely attach the top tube 3 and the side tubes to the front tube 1, and then turning the rear tube 2 inwards toward the front tube 1.

Figure 13:
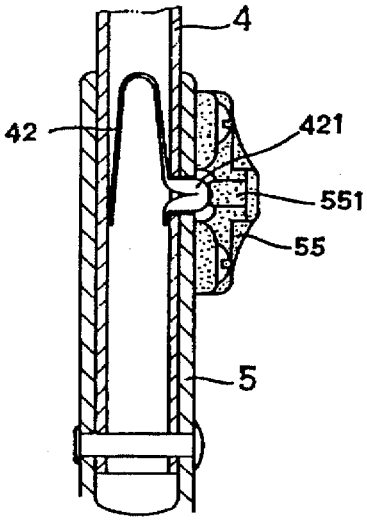
FIG. 13 is similar to FIG. 10 but showing a press spring mounted outside the connecting frame and the rod of the spring plate aimed at the raised portion of the spring plate of the side tube.
Figure 14:
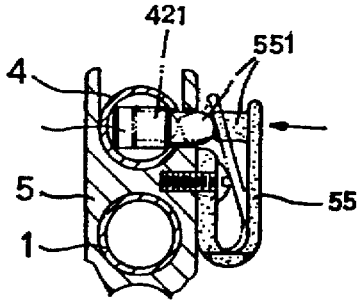
FIG. 14 is a bottom view of FIG. 13.

Referring to FIGS. 13 and 14, a press spring 55 may be fixedly secured to the outside wall of each connecting frame 5 adjacent to the respective retaining hole 54. The press spring 55 has a rod 551 at an inner side disposed in alignment with the respective retaining hole 54. By pressing the press spring 55 to force the rod 551 into the retaining hole 54 of the respective connecting frame 5, the raised portion 421 of the spring plate 42 of the respective side tube 4 is disconnected from the retaining hole 54, for permitting the respective side tube 4 to be turned out of the top open chamber 51 of the respective connecting frame 5.

It is to be understood that the drawings are designed for purposes of illustration only, and are not intended as a definition of the limits and scope of the invention disclosed.

What the invention claimed is:

1. A folding collapsible frame assembly for baby carriers, comprising a substantially U-shaped front tube having two opposite ends, two connecting frames respectively and fixedly fastened to the two opposite ends of said front tube, two rear tubes respectively pivoted to said connecting frames, a substantially U-shaped top tube having two opposite ends, two holder frames respectively and fixedly connected to the two opposite ends of said top tube, two side tubes connected between said holder frames and said connecting frames, each of said side tubes having a bottom end pivoted to one connecting frame and a top end pivoted to one holder frame, and two movable locating devices respectively mounted on said side tubes and controlled to lock said holder frames, wherein: said connecting frames have a respective retaining hole adapted for holding said side tubes in the operative position; each of said side tubes comprises a slot spaced from the bottom end thereof, a spring plate fixedly mounted inside said slot and having a raised portion at an outer side partially projecting out of said slot and adapted for engaging the retaining hole of the respective connecting frame to hold the respective side tube in the operative position; said holder frames have a respective first bottom notch and a respective second bottom notch; each of said locating devices comprises a spring fastened to one side tube on the outside and a socket sliding on one side tube and supported on the spring of the respective locating device and forced by it into engagement with one of the first bottom notch and second bottom notch of one holder frame, said socket having a top flange which is forced into engagement with the first bottom notch of the corresponding holder frame when the folding collapsible frame assembly is extended out, or the second bottom notch of the corresponding holder frame when the folding collapsible frame assembly is collapsed.

2. The folding collapsible frame assembly of claim 1 wherein said connecting frames have a respective stop block on the inside adapted for holding said rear tube in the operative position.

3. The folding collapsible frame assembly of claim 1 wherein the socket of each of said locating devices has a longitudinal through hole through which the corresponding side tube passes, a downward sliding groove on the inside longitudinally disposed in communication with said longitudinal through hole at one side, and a downward spring chamber longitudinally disposed in communication with said longitudinal through hole at an opposite side; the spring of each of said locating devices is mounted inside the downward spring chamber of the corresponding locating device to impart the corresponding locating device with an upward pressure, having a top end connected to the socket of the corresponding locating device and a bottom end connected to a locating block, which is fixedly secured to a rivet, which is fastened to a transverse hole on the corresponding side tube and having one end connected to said locating block and an opposite end perpendicularly inserted into the downward sliding groove of the socket of the corresponding locating device to guide the movement of the socket of the corresponding locating device.

4. The folding collapsible frame assembly of claim 1 wherein said connecting frames have a respective press means disposed on the outside and aimed at the respective retaining hole and adapted for pressing into the respective retaining hole to force the raised portion of the spring plate of the corresponding side tube out of the retaining hole of the corresponding connecting frame.

* * * * *